US008657610B2

(12) United States Patent
Lee et al.

(10) Patent No.: US 8,657,610 B2
(45) Date of Patent: Feb. 25, 2014

(54) PORTABLE ELECTRONIC DEVICE WITH COLLAPSIBLE PLUG

(75) Inventors: Gen-Kwo Lee, Taipei (TW); Ming-Tsai Chung, Taipei (TW)

(73) Assignee: D-Link Corporation, Taipei (TW)

( * ) Notice: Subject to any disclaimer, the term of this patent is extended or adjusted under 35 U.S.C. 154(b) by 149 days.

(21) Appl. No.: 13/352,482

(22) Filed: Jan. 18, 2012

(65) Prior Publication Data

US 2013/0115792 A1 May 9, 2013

(30) Foreign Application Priority Data

Nov. 3, 2011 (TW) ..... 100140098 A

(51) Int. Cl.
*H01R 13/44* (2006.01)

(52) U.S. Cl.
USPC ..... 439/131

(58) Field of Classification Search
USPC ..... 439/131, 130, 135, 31
See application file for complete search history.

(56) References Cited

U.S. PATENT DOCUMENTS

| | | | | |
|---|---|---|---|---|
| 6,190,184 | B1 * | 2/2001 | Cimbal et al. | 439/131 |
| 6,567,273 | B1 * | 5/2003 | Liu et al. | 361/737 |
| 6,676,420 | B1 * | 1/2004 | Liu et al. | 439/131 |
| 6,786,743 | B2 * | 9/2004 | Huang | 439/131 |
| 6,793,509 | B2 * | 9/2004 | Chen | 439/136 |
| 7,009,847 | B1 * | 3/2006 | Wu et al. | 361/737 |
| 7,025,275 | B2 * | 4/2006 | Huang et al. | 235/486 |
| 7,179,099 | B2 * | 2/2007 | Hsieh | 439/131 |
| 7,295,431 | B2 * | 11/2007 | Chuang | 361/679.55 |
| D559,249 | S * | 1/2008 | Takei | D14/480.6 |
| 7,473,112 | B2 * | 1/2009 | Zhu et al. | 439/142 |
| 7,484,972 | B1 * | 2/2009 | Kuo et al. | 439/131 |
| 7,485,499 | B2 * | 2/2009 | Brewer et al. | 438/125 |
| 7,494,349 | B1 * | 2/2009 | Huang et al. | 439/131 |
| 7,533,825 | B2 * | 5/2009 | Kodera et al. | 235/486 |
| 7,544,101 | B1 * | 6/2009 | Tseng | 439/668 |
| 7,893,990 | B1 * | 2/2011 | Kaplan et al. | 348/373 |
| D639,329 | S * | 6/2011 | Kaplan et al. | D16/219 |
| 8,189,101 | B2 * | 5/2012 | Cummings et al. | 348/376 |
| 8,241,047 | B2 * | 8/2012 | Ni et al. | 439/131 |
| 8,246,362 | B2 * | 8/2012 | Ma | 439/131 |
| 8,272,884 | B2 * | 9/2012 | Lin et al. | 439/131 |
| 8,308,494 | B1 * | 11/2012 | Zhao | 439/131 |
| 8,325,239 | B2 * | 12/2012 | Kaplan et al. | 348/207.1 |
| 2003/0045176 | A1 * | 3/2003 | Liu | 439/687 |
| 2006/0019519 | A1 * | 1/2006 | Son | 439/131 |
| 2006/0199435 | A1 * | 9/2006 | Foo et al. | 439/638 |
| 2010/0075517 | A1 * | 3/2010 | Ni et al. | 439/131 |

* cited by examiner

*Primary Examiner* — Amy Cohen Johnson
*Assistant Examiner* — Vladimir Imas
(74) *Attorney, Agent, or Firm* — Bacon & Thomas, PLLC

(57) ABSTRACT

A portable electronic device including a main body having one end concavely provided with a receiving groove, a pivot pin provided in the receiving groove, a pivot seat pivotally connected to the pivot pin, a transmission line having one end electrically connected to a circuit board provided in the main body and the other end extending into the receiving groove, and a plug having one end embedded in the pivot seat. Since the pivot pin has a hollow configuration, the other end of the transmission line is able to pass through the pivot pin and be electrically connected to the plug, allowing the plug to be rotated and received in the receiving groove when the portable electronic device is not in use and preventing the transmission line from being pulled or curled due to rotation of the plug.

9 Claims, 6 Drawing Sheets

PORTABLE ELECTRONIC DEVICE WITH COLLAPSIBLE PLUG

FIELD OF THE INVENTION

The present invention relates to a portable electronic device with a collapsible plug, more particularly to a portable electronic device having a pivot pin, wherein the pivot pin has a hollow configuration and is pivotally connected to the plug, so as to enable a transmission line extending from the portable electronic device to pass through the pivot pin and electrically connect to the plug. When the portable electronic device is not in use, the plug can be rotated and received in a receiving groove of the portable electronic device, and the two ends of the transmission line will not be pulled or curled due to rotation of the plug. Thus, the transmission stability and the service life of the transmission line are ensured.

BACKGROUND OF THE INVENTION

Recently, with the improvement of electronic technology, a great variety of portable electronic devices have been developed, including USB flash drives, wireless network transceivers, wireless mouse transceivers, and USB keys, to name only a few. These portable electronic devices typically have a plug to be directly inserted into an electronic apparatus (e.g., a personal computer or a laptop computer) so that the electronic apparatus can transfer data to and from the portable electronic device or execute specific functions (e.g., receiving network signals) via the portable electronic device. However, as the electronic apparatus may have several sockets configured for such plug insertion, and the sockets are usually grouped together in such a way that a plurality of portable electronic devices cannot connect to the electronic apparatus without obstructing each other, it is extremely difficult to make multiple plug connections at the same time. If it is necessary to make such connections, additional connection cables are required to position the multiple portable electronic devices in an offset relationship, which is rather inconvenient.

As a solution to the aforesaid problem, a portable electronic device with a rotatable plug was designed, wherein the plug can be freely rotated to adjust the position of the portable electronic device in the connected state. Referring to FIG. 1, a portable electronic device 1 of this kind includes a housing 11, a pivotal element 12, and a plug 13. The housing 11 is composed of a first housing member 111 and a second housing member 112. Once the first housing member 111 and the second housing member 112 are put together to form the housing 11, an accommodating space S1 and a receiving groove S2 are defined therein. A circuit element (not shown) is accommodated in the accommodating space S1, and a pivot seat 110 having a spherical interior space is received in the receiving groove S2. The pivotal element 12 is pivotally provided at one end of the plug 13 and corresponds in configuration to the interior space of the pivot seat 110 so as to rotate freely therein. The pivotal element 12 is also connected with a transmission line 14. The transmission line 14 extends out of the pivot seat 110 to make electrical connection with the circuit element. With the pivotal element 12 pivotally connected to the pivot seat 110, the plug 13 can rotate along with the pivotal element 12 until the plug 13 is received in the receiving groove S2 or secured outside the housing 11 at a position corresponding to the receiving groove S2.

While the plug 13 of the portable electronic device 1 is freely rotatable and adjustable by the user and can be conveniently received in the receiving groove S2, it still has the following drawbacks in use:

(1) Difficulty in rotation: Referring to FIG. 1, the transmission line 14, which extends out of the pivot seat 110 to electrically connect with the circuit element, will be pulled by the plug 13 or even curled along the pivot seat 110 when the plug 13 is rotated. Consequently, not only is the transmission line 14 subject to wear and tear, but also the smoothness of rotation of the plug 13 is impaired, which hinders the use of the plug 13.

(2) Limited rotation: As stated above, the transmission line 14 tends to be pulled or curled when the plug 13 is turned. Therefore, the extent to which the plug 13 can be rotated is limited by the length of the transmission line 14. If the plug 13 cannot be sufficiently rotated, it may have problem avoiding physical contact between the portable electronic device 1 and an adjacent portable electronic device.

(3) An excessively large space occupied: In order for the pivotal element 12 to rotate freely in the pivot seat 110, the interior space of the pivot seat 110 must be spherical, and because of that, the pivot seat 110 and the pivotal element 12 occupy a very large space, which is against the trend of portable electronic devices toward increasingly smaller and slimmer designs. Moreover, as previously mentioned, the transmission line 14 of the portable electronic device 1 must be long enough to allow smooth rotation of the plug 13. This long transmission line 14 nevertheless adds to the overall volume of the portable electronic device 1.

(4) Insufficient structural strength: Referring again to FIG. 1, there is a partition 113 between the receiving groove S2 and the accommodating space S1 so that the plug 13, once received in the receiving groove S2, is pressed against the partition 113 to give the user an assuring feel that the plug 13 is stored in place. However, given the trend toward making the portable electronic device 1 as compact as possible, the thickness of the partition 113 is often limited. As a result, the partition 113 tends to deform due to the pressing force of the plug 13 after the portable electronic device 1 is used for a long time.

According to the foregoing, the rotatable plug of a conventional portable electronic device cannot rotate without pulling or curling the transmission line and therefore suffers from difficulty and limitation in rotation. The rotatable plug also results in bulkiness of the portable electronic device. Hence, the issue to be addressed by the present invention is to design a portable electronic device and provide it with a rotatable plug that will not pull or curl the transmission line when in use or have the other problems mentioned above.

BRIEF SUMMARY OF THE INVENTION

It view of the fact that the plug of a conventional portable electronic device tends to pull or curl the transmission line in the device while being rotated, thus subjecting the transmission line to wear and tear, the inventor of the present invention put years of practical experience into related research and trials and finally succeeded in developing a portable electronic device with a collapsible plug as disclosed herein.

It is an object of the present invention to provide a portable electronic device with a collapsible plug, wherein the portable electronic device includes a main body, a pivot seat, and at least one transmission line, in addition to the plug. The main body can be a wireless transceiver, an USB key, an USB flash drive, or the like. The main body forms an accommodating space therein and has one end concavely provided with a receiving groove. The receiving groove defines a first opening at the aforesaid end of the main body. A circuit board is provided in the accommodating space, while a pivot pin is provided in the receiving groove. The pivot pin has a hollow configuration and is formed with a first through hole and a second through hole. The first through hole corresponds in position to the circuit board and communicates with the second through hole. The pivot seat has a pivot hole formed adjacent to a first end of the pivot seat. The pivot hole corresponds in configuration to the pivot pin to enable pivotal connection between the pivot seat and the pivot pin. The pivot seat can be rotated about an axis defined by the pivot pin, thus allowing a second end of the pivot seat to be completely received in the receiving groove or be secured outside the main body at a position corresponding to the first opening. The plug has a first end which corresponds in configuration to the second end of the pivot seat and which is embedded in the pivot seat. When the pivot seat is rotated about the axis defined by the pivot pin, a second end of the plug can be completely received in the receiving groove or secured outside the main body at a position corresponding to the first opening. The transmission line has one end electrically connected to the circuit board and the other end extending into the receiving groove, passing sequentially through the first through hole and the second through hole, and electrically connected to a circuit module in the plug. Thus, the portable electronic device can make electrical connection with an electronic apparatus via the plug, and when the portable electronic device is not in use, the plug can be rotated and received in the receiving groove. Moreover, as the middle section of the transmission line is positioned in the pivot pin, the two ends of the transmission line will not be pulled or curled due to rotation of the pivot seat about the axis defined by the pivot pin. Hence, not only is the stability of signal transmission by the transmission line ensured, but also the service life of the transmission line is prevented from being cut short.

BRIEF DESCRIPTION OF THE SEVERAL VIEWS OF THE DRAWINGS

The structure as well as a preferred mode of use, further objects, and advantages of the present invention will be best understood by referring to the following detailed description of some illustrative embodiments in conjunction with the accompanying drawings, in which.

DETAILED DESCRIPTION OF THE INVENTION

Figure 1:
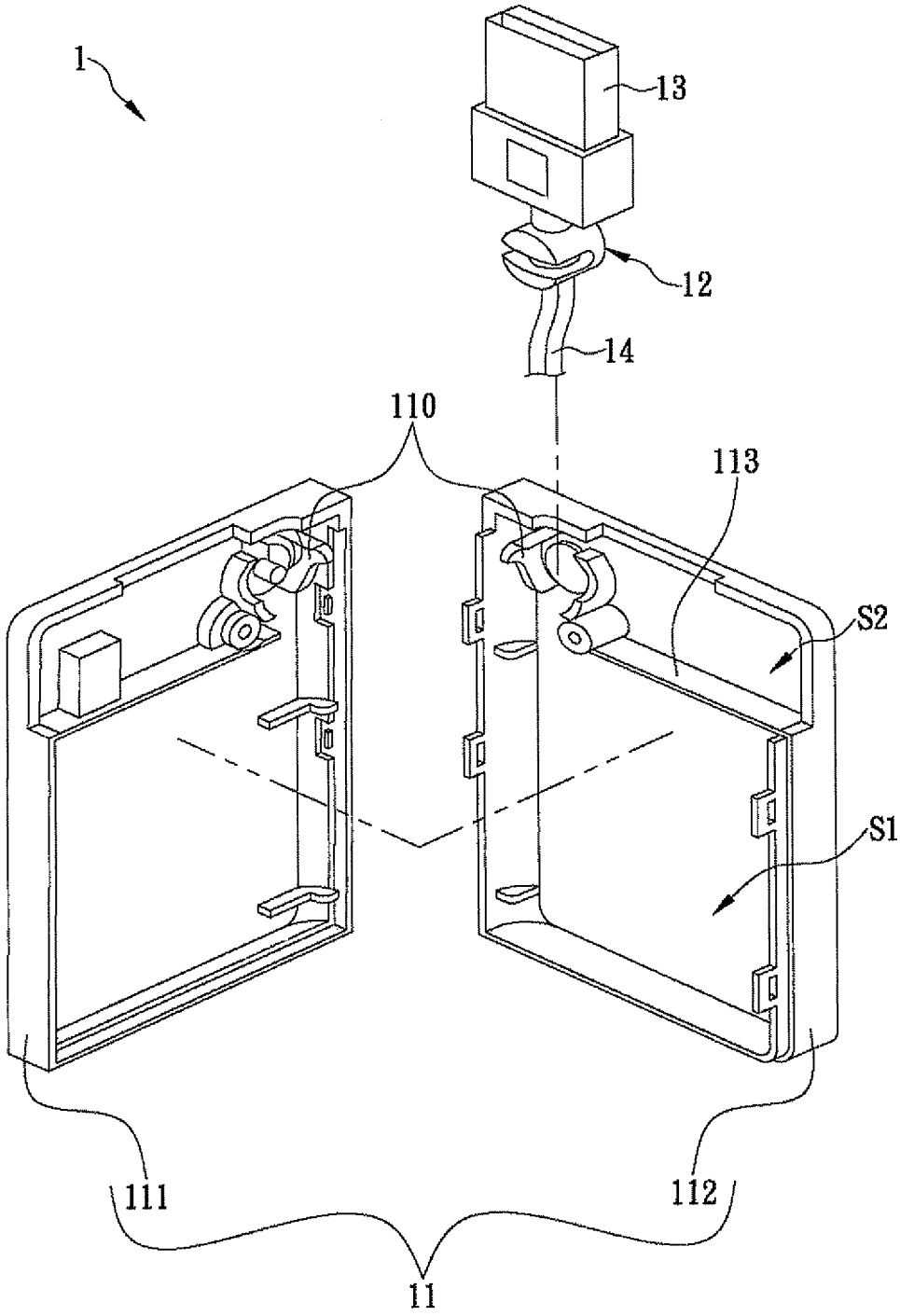
FIG. 1(Prior Art)
FIG. 1 is an exploded perspective view of a conventional portable electronic device.
Figure 2:
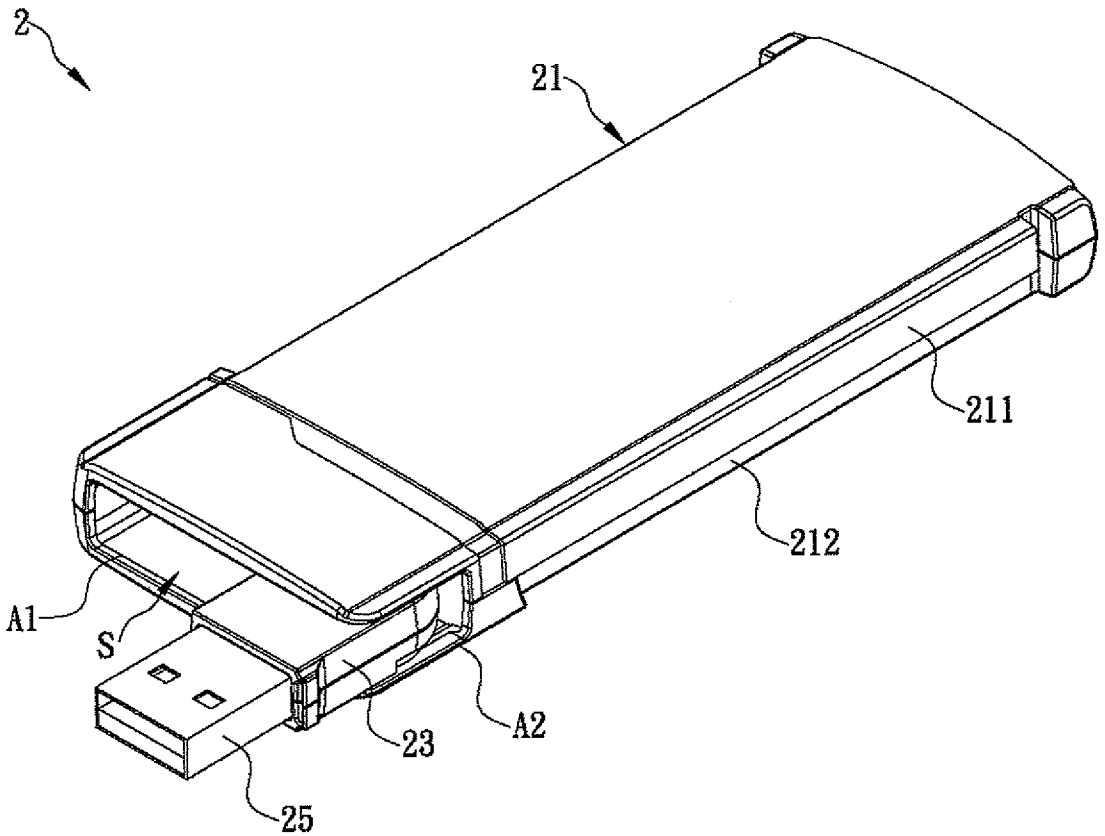
FIG. 2. is a perspective view of a portable electronic device according to the first preferred embodiment of the present invention.
Figure 3:
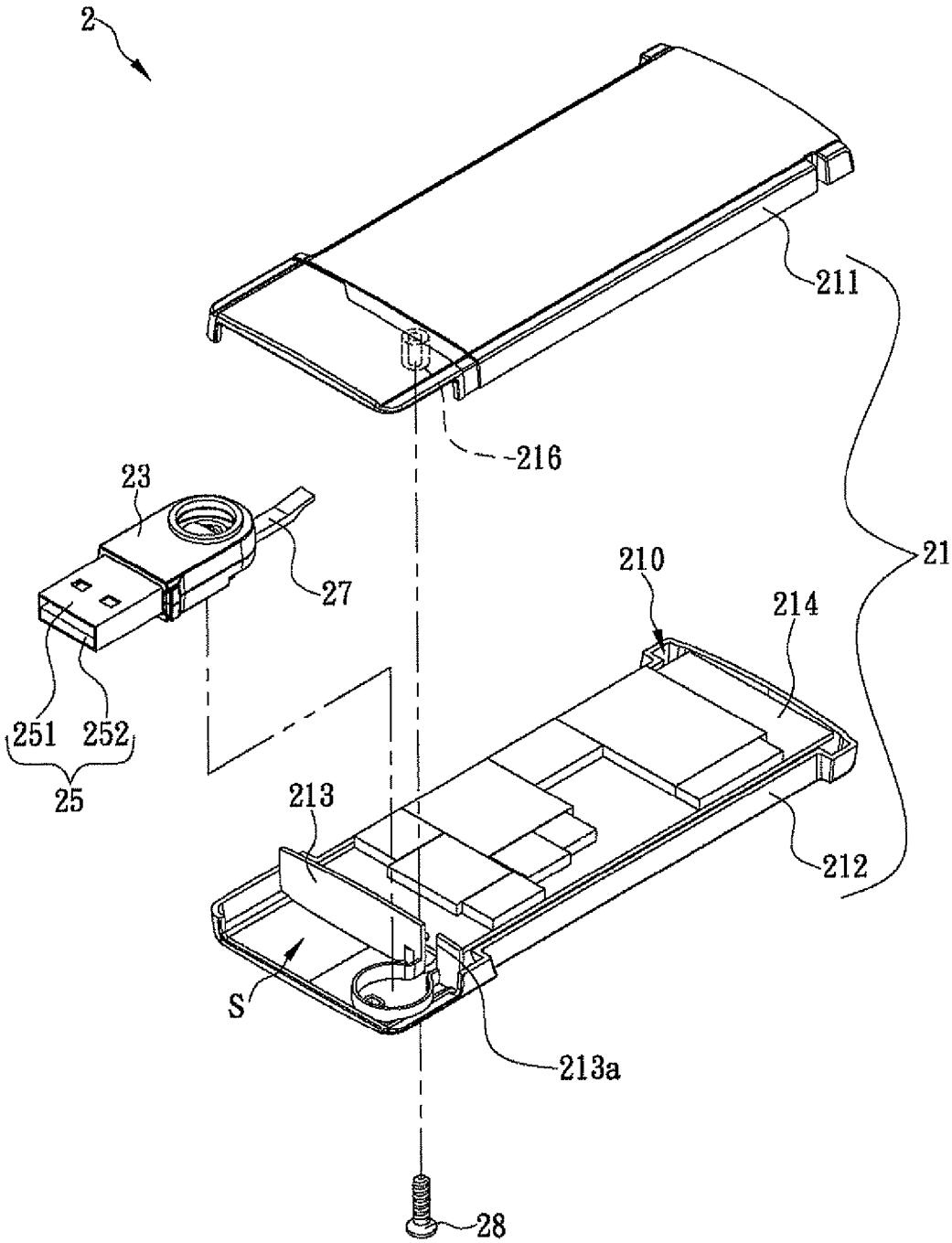
FIG. 3 is an exploded perspective view of the portable electronic device according to the first preferred embodiment of the present invention.

The present invention discloses a portable electronic device with a collapsible plug. Referring to FIGS. 2 and 3 for the first preferred embodiment of the present invention, a portable electronic device 2 includes a main body 21, a pivot seat 23, a plug 25, and at least one transmission line 27. The main body 21 includes an upper housing 211 and a lower housing 212. The upper housing 211 and the lower housing 212 can be assembled together to form an accommodating space 210 in the main body 21 and a first opening A1 and a receiving groove S at one end of the main body 21. Between the accommodating space 210 and the receiving groove S is a positioning plate 213. The positioning plate 213 has a connection hole 213*a* through which the accommodating space 210 and the receiving groove S communicate with each other.

Figure 4:
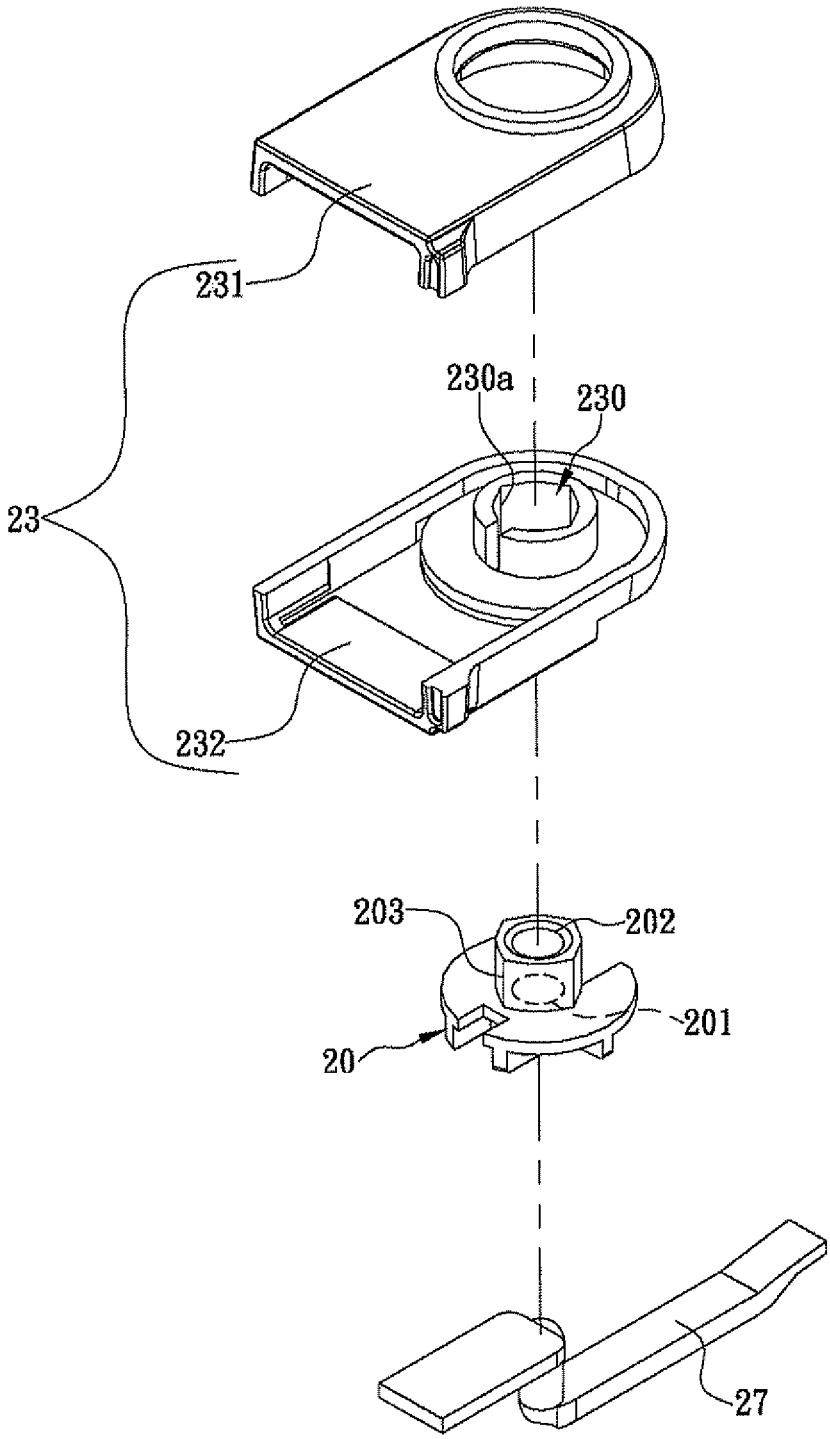
FIG. 4 is a partial exploded perspective view of the portable electronic device according to the first preferred embodiment of the present invention.

As shown in FIGS. 2 and 3, the accommodating space 210 is provided therein with a circuit board 214, and the circuit board 214 corresponds in position to the connection hole 213*a*. The receiving groove S, on the other hand, is provided therein with a pivot pin 20. Referring to FIGS. 3 and 4, the pivot pin 20 is located in the receiving groove S and corresponds in position to the connection hole 213*a*. The bottom of the pivot pin 20 is formed with a first through hole 201 corresponding in position to the circuit board 214. The top of the pivot pin 20 is formed with a second through hole 202. The second through hole 202 is in communication with the first through hole 201 such that the pivot pin 20 has a hollow configuration. The pivot seat 23 is composed of an upper cover 231 and a lower cover 232. In addition, the pivot seat 23 has a pivot hole 230 adjacent to a first end of the pivot seat 23. The pivot hole 230 corresponds in configuration to the pivot pin 20, thus allowing the pivot seat 23 to be movably mounted around the pivot pin 20. The pivot seat 23 can be rotated about an axis defined by the pivot pin 20 so that a second end of the pivot seat 23 can be completely received in the receiving groove S or be secured outside the main body 21 at a position corresponding to the first opening A1. The plug 25 includes a protective casing 251 and a circuit module 252 embedded in the protective casing 251. A first end of the plug 25 corresponds in configuration to the pivot seat 23 and is embedded between the upper cover 231 and the lower cover 232. When the pivot seat 23 is rotated about the axis defined by the pivot pin 20, the plug 25 is driven to rotate by the pivot seat 23. More particularly, the plug 25 can be received in the receiving groove S or secured outside the main body 21 at a position corresponding to the first opening A1.

Figure 5:
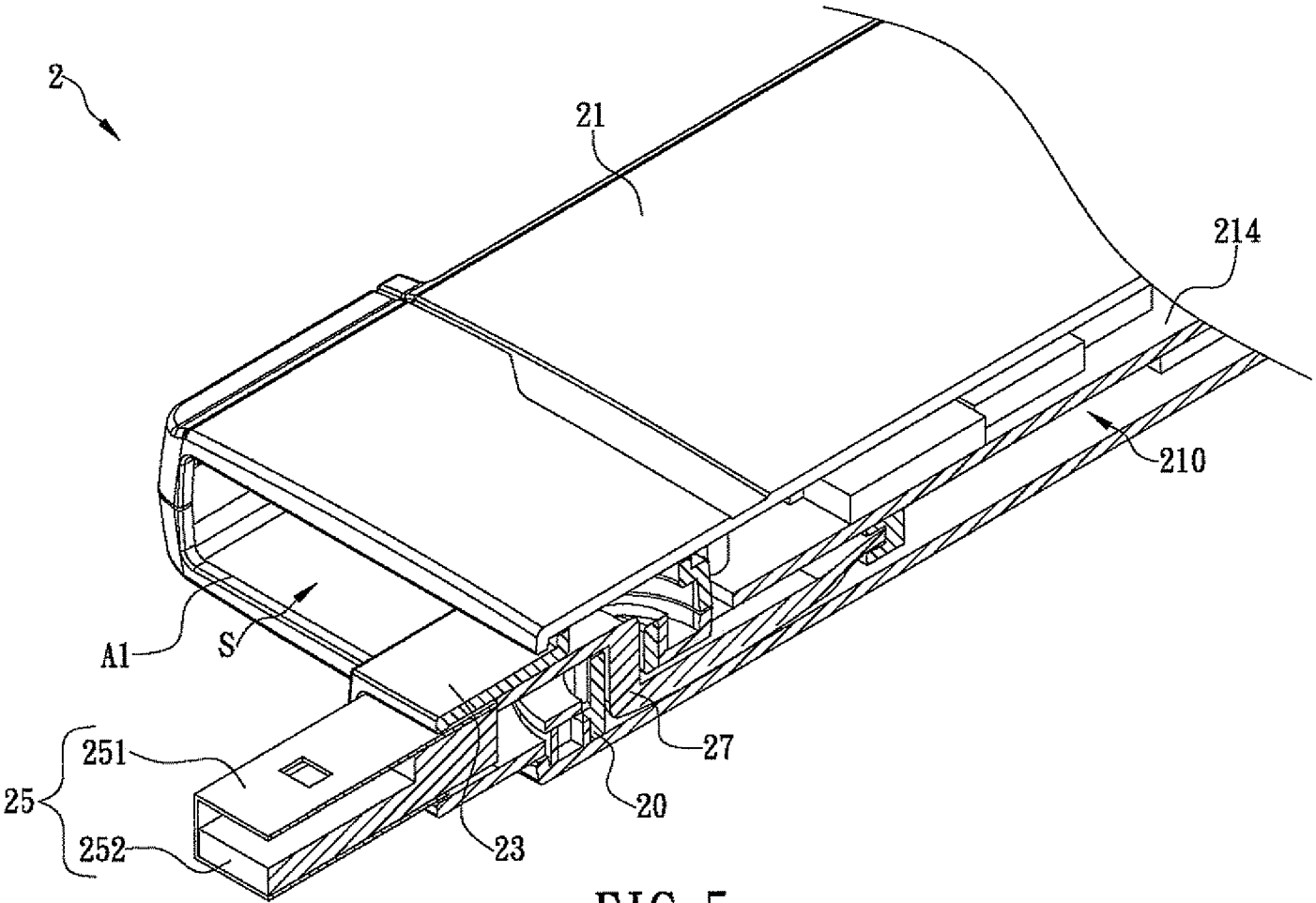
FIG. 5 is a sectional view of the portable electronic device according to the first preferred embodiment of the present invention.

Referring to FIGS. 3, 4, and 5, the transmission line 27 has one end electrically connected to the circuit board 214 and the other end extending into the receiving groove S. The latter end of the transmission line 27 further extends into the pivot pin 20 via the first through hole 201, comes out of the top of the pivot pin 20 via the second through hole 202, and is electrically connected to the circuit module 252. With the middle section of the transmission line 27 being positioned inside the pivot pin 20, the transmission line 27 is prevented from being pulled or curled by rotation of the second end of the pivot seat 23 while the pivot seat 23 is rotated about the axis defined by the pivot pin 20. This ensures that the transmission line 27 provides stable signal transmission and will not have its service life cut short. Furthermore, with the transmission line 27 being positioned in the pivot pin 20, the plug 25 can rotate smoothly, and the required interior space of the portable electronic device 2 is reduced to enable a thinner and smaller design of the portable electronic device 2.

Referring again to FIGS. 2 to 4, now that the disclosed portable electronic device 2 is capable of smooth rotation and the transmission line 27 will not be pulled by rotation of the pivot seat 23, the main body 21 is additionally provided with a second opening A2 which lies on a lateral side of the main body 21 that is adjacent to the first opening A1. The second opening A2 communicates with the first opening A1 so that, when the pivot seat 23 is rotated about the axis defined by the pivot pin 20, a second end of the plug 25 can be rotated out of the main body 21 to a position corresponding to the second opening A2. In other words, the plug 25 can be rotated by at least 180 degrees, which substantially increases the flexibility of use of the portable electronic device 2.

Figure 6:
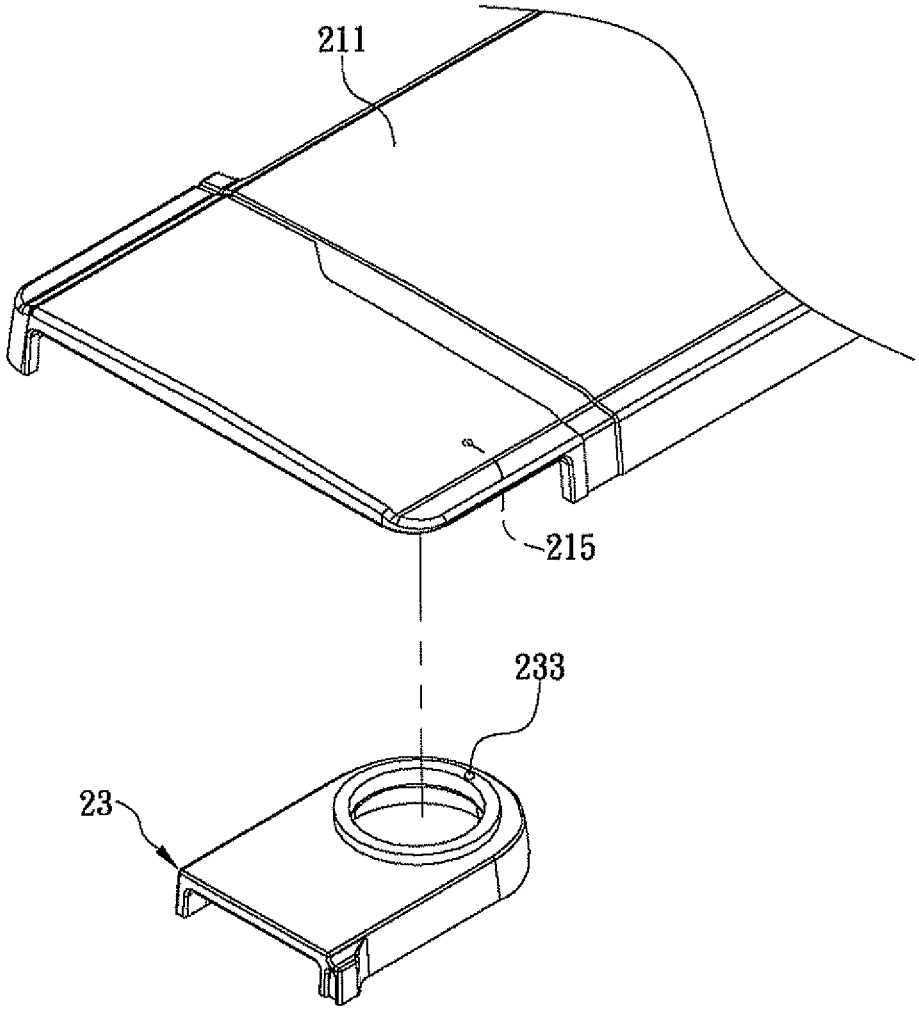
FIG. 6 is a partial view of a portable electronic device according to another preferred embodiment of the present invention.

In the second preferred embodiment of the present invention, referring to FIGS. 3 and 4, the top of the pivot pin 20 has a polygonal cross-section (e.g., a hexagonal cross-section as in this embodiment); that is to say, the outer periphery at the top of the pivot pin 20 forms a plurality of salient angle portions 203. On the other hand, the inner wall of the pivot hole 230 is concavely provided with a plurality of positioning portions 230*a* which correspond in position respectively to the salient angle portions 203. While the pivot seat 23 is rotated about the axis defined by the pivot pin 20, the salient angle portions 203 are respectively and successively engaged with the positioning portions 230*a*. This allows the plug 25 to be secured at any one of a plurality of positions corresponding to the salient angle portions 203. In should be pointed out, however, that the pivot seat 23 can be secured in position by means other than depicted in FIG. 4. The method for positioning the pivot seat 23 may vary in other preferred embodiments of the present invention. Referring to FIG. 6 in conjunction with FIG. 3 for the third preferred embodiment of the present invention for example, the top of the pivot seat 23 (some of whose components are omitted in FIG. 6 for the sake of clarity) is protrudingly provided with a protuberance 233, and the upper housing 211 is concavely provided with a plurality of engaging portions 215 corresponding in position to the pivot seat 23. In the course where the pivot seat 23 is rotated, referring to FIGS. 2 and 6, the protuberance 233 can engage with each engaging portion 215 successively, thus allowing the plug 25 to be positioned in the receiving groove S, or secured outside the main body 21 at a position corresponding to the first opening A1, or secured outside the main body 21 at a position corresponding to the second opening A2.

In a different preferred embodiment of the present invention, referring to FIG. 4, the protuberance is provided at the bottom of the pivot seat 23, and the engaging portions are provided on the pivot pin 20 at positions corresponding to the protuberance. This arrangement of the protuberance and the engaging portions allows the pivot seat 23 to be secured at different positions as well.

Referring to FIGS. 2 and 3, in the fourth preferred embodiment of the present invention, the bottom side of the upper housing 211 is provided with a fastening portion 216 at a position corresponding to an intermediate position between the positioning plate 213 and the circuit board 214. A fastener 28 passing through the lower housing 212 and fastened with the fastening portion 216 can secure the upper housing 211 and the lower housing 212 tightly together. Meanwhile, the fastener 28 presses against a lateral side of the positioning plate 213 that faces the circuit board 214; as a result, the structural strength of the positioning plate 213 is enhanced by the support of the fastener 28.

While the invention herein disclosed has been described by means of specific embodiments, numerous modifications and variations could be made thereto by those skilled in the art without departing from the scope of the invention set forth in the claims.

What is claimed is:

1. A portable electronic device with a collapsible plug, comprising:

a main body having an accommodating space therein and an end concavely provided with a receiving groove, wherein the receiving groove defines a first opening at the end of the main body;

a circuit board provided within the accommodating space;

a pivot pin provided within the receiving groove, wherein the pivot pin has a first through hole and a second through hole in communication with the first through hole such that the pivot pin has a hollow configuration;

a pivot seat formed with a pivot hole, the pivot hole being adjacent to a first end of the pivot seat and corresponding in configuration to the pivot pin, the pivot seat being pivotally connected to the pivot pin via the pivot hole so that, when the pivot seat is rotated about an axis defined by the pivot pin, a second end of the pivot seat can be completely received in the receiving groove or secured outside the main body at a position corresponding to the first opening;

the plug having a circuit module provided therein and a first end corresponding in configuration to and embedded in the second end of the pivot seat, wherein the plug is driven to rotate when the pivot seat is rotated about the axis defined by the pivot pin, and a second end of the plug can be completely received in the receiving groove or secured outside the main body at the position corresponding to the first opening; and at least a transmission line having an end electrically connected to the circuit board and an opposite end passing sequentially through the first through hole and the second through hole and electrically connected to the circuit module for preventing the transmission line from being pulled or curled in the electronic device from rotation of the pivot seat about the axis defined by the pivot pin.

2. The portable electronic device of claim 1, wherein the receiving groove forms a second opening on a lateral side of the main body that is adjacent to the first opening, the second opening communicating with the first opening so that, when the plug is driven to rotate by rotation of the pivot seat about the axis defined by the pivot pin, the second end of the plug can be completely received in the receiving groove or secured outside the main body at a position corresponding to the second opening.

3. The portable electronic device of claim 2, wherein the pivot pin has a top formed with a plurality of salient angle portions, and the pivot hole has an inner wall concavely provided with a plurality of positioning portions corresponding in position respectively to the salient angle portions so that, when the pivot seat is rotated about the axis defined by the pivot pin, the salient angle portions are respectively and successively engaged with the positioning portions, allowing the second end of the plug to be positioned at any of a plurality of positions corresponding to the salient angle portions.

4. The portable electronic device of claim 2, wherein the pivot seat has a top provided with at least a protuberance, and the main body is provided therein with at least an engaging portion corresponding in position to the pivot seat so that, when the pivot seat is rotated about the axis defined by the pivot pin, the at least a protuberance is respectively and successively engaged with the at least an engaging portion, allowing the plug to be positioned in the receiving groove, or secured outside the main body at a position corresponding to the first opening, or secured outside the main body at a position corresponding to the second opening.

5. The portable electronic device of claim 2, further comprising a positioning plate between the receiving groove and the accommodating space, wherein the plug, once received in the receiving groove, presses against the positioning plate.

6. The portable electronic device of claim 5, wherein the main body comprises an upper housing and a lower housing connected with the upper housing such that the accommodating space is formed therebetween, the upper housing having a bottom side provided with a fastening portion corresponding to an intermediate position between the circuit board and the positioning plate, a fastener passing through the lower housing and fastened with the fastener to secure the upper housing and the lower housing tightly together, the fastener pressing against a lateral side of the positioning plate that corresponds in position to the circuit board.

7. The portable electronic device of claim 2, wherein the first through hole is provided at a bottom of the pivot pin, and the second through hole is provided at a top of the pivot pin.

8. A portable electronic device with a collapsible plug, comprising:

a main body having an accommodating space therein and an end concavely provided with a receiving groove, the accommodating space being provided therein with a circuit board, the receiving groove being provided therein with a pivot pin and defining a first opening at the end of the main body, the pivot pin having a first through hole and a second through hole in communication with the first through hole such that the pivot pin has a hollow configuration;

a pivot seat formed with a pivot hole, the pivot hole being adjacent to a first end of the pivot seat and corresponding in configuration to the pivot pin, the pivot seat being pivotally connected to the pivot pin via the pivot hole so that, when the pivot seat is rotated about an axis defined by the pivot pin, a second end of the pivot seat can be completely received in the receiving groove or secured outside the main body at a position corresponding to the first opening;

the plug having a first end corresponding in configuration to the second end of, and embedded in, the pivot seat, wherein the plug is driven to rotate when the pivot seat seat is rotated about the axis defined by the pivot pin, and a second end of the plug can be completely received in the receiving groove or secured outside the main body at a position corresponding to the first opening;

at least a transmission line having an end electrically connected to the circuit board and an opposite end passing sequentially through the first through hole and the second through hole and electrically connected to a circuit module in the plug;

the receiving groove forms a second opening on a lateral side of the main body that is adjacent to the first opening, the second opening communicating with the first opening so that, when the plug is driven to rotate by rotation of the pivot seat about the axis defined by the pivot pin, the second end of the plug can be completely received in the receiving groove or secured outside the main body at a position corresponding to the second opening; and wherein the pivot pin has a top formed with a plurality of salient angle portions, and the pivot hole has an inner wall concavely provided with a plurality of positioning portions corresponding in position respectively to the salient angle portions so that, when the pivot seat is rotated about the axis defined by the pivot pin, the salient angle portions are respectively and successively engaged with the positioning portions, allowing the second end of the plug to be positioned at any of a plurality of positions corresponding to the salient angle portions.

9. A portable electronic device with a collapsible plug, comprising:

a main body having an accommodating space therein and an end concavely provided with a receiving groove, the accommodating space being provided therein with a circuit board, the receiving groove being provided therein with a pivot pin and defining a first opening at the end of the main body, the pivot pin having a first through hole and a second through hole in communication with the first through hole such that the pivot pin has a hollow configuration;

a pivot seat formed with a pivot hole, the pivot hole being adjacent to a first end of the pivot seat and corresponding in configuration to the pivot pin, the pivot seat being pivotally connected to the pivot pin via the pivot hole so that, when the pivot seat is rotated about an axis defined by the pivot pin, a second end of the pivot seat can be completely received in the receiving groove or secured outside the main body at a position corresponding to the first opening;

the plug having a first end corresponding in configuration to the second end of, and embedded in, the pivot seat, wherein the plug is driven to rotate when the pivot seat is rotated about the axis defined by the pivot pin, and a second end of the plug can be completely received in the receiving groove or secured outside the main body at a position corresponding to the first opening;

at least a transmission line having an end electrically connected to the circuit board and an opposite end passing sequentially through the first through hole and the second through hole and electrically connected to a circuit module in the plug;

the receiving groove forms a second opening on a lateral side of the main body that is adjacent to the first opening, the second opening communicating with the first opening so that, when the plug is driven to rotate by rotation of the pivot seat about the axis defined by the pivot pin, the second end of the plug can be completely received in the receiving groove or secured outside the main body at a position corresponding to the second opening; and wherein the pivot seat has a top provided with at least a protuberance, and the main body is provided therein with at least an engaging portion corresponding in position to the pivot seat so that, when the pivot seat is rotated about the axis defined by the pivot pin, the at least a protuberance is respectively and successively engaged with the at least an engaging portion, allowing the plug to be positioned in the receiving groove, or secured outside the main body at a position corresponding to the first opening, or secured outside the main body at a position corresponding to the second opening.

* * * * *